US010890323B2

(12) United States Patent
Lehtonen

(10) Patent No.: US 10,890,323 B2
(45) Date of Patent: Jan. 12, 2021

(54) CIRCULATING FLUIDIZED BED BOILER WITH A LOOPSEAL HEAT EXCHANGER

(71) Applicant: Valmet Technologies Oy, Espoo (FI)

(72) Inventor: Pekka Lehtonen, Tampere (FI)

(73) Assignee: Valmet Technologies Oy, Espoo (FI)

( * ) Notice: Subject to any disclaimer, the term of this patent is extended or adjusted under 35 U.S.C. 154(b) by 134 days.

(21) Appl. No.: 16/342,485

(22) PCT Filed: Nov. 1, 2016

(86) PCT No.: PCT/FI2016/050760
§ 371 (c)(1),
(2) Date: Apr. 16, 2019

(87) PCT Pub. No.: WO2018/083367
PCT Pub. Date: May 11, 2018

(65) Prior Publication Data
US 2019/0249866 A1 Aug. 15, 2019

(51) Int. Cl.
*F23C 10/10* (2006.01)
*F22B 31/00* (2006.01)
(Continued)

(52) U.S. Cl.
CPC ..... *F23C 10/10* (2013.01); *F22B 31/00* (2013.01); *F22B 31/0007* (2013.01);
(Continued)

(58) Field of Classification Search
CPC ..... F22B 31/00; F22B 37/10; F22B 31/0007; F23C 10/26; F23C 10/06; F23C 10/10; F23C 10/04; F23C 2206/10; F23J 1/00
See application file for complete search history.

(56) References Cited

U.S. PATENT DOCUMENTS 4,227,488 A 10/1980 Stewart et al.
4,869,207 A 9/1989 Engstrom et al.
(Continued)

FOREIGN PATENT DOCUMENTS

CN 1499130 A 5/2004
EP 2884172 A1 6/2015
(Continued)

OTHER PUBLICATIONS

Extended European Search Report for European Patent Application No. 16920727.1, dated May 15, 2020, (8 pages), European Patent Office, Munich, Germany.
(Continued)

*Primary Examiner* — David J Laux
*Assistant Examiner* — Nikhil P Mashruwala
(74) *Attorney, Agent, or Firm* — Alston & Bird LLP

(57) ABSTRACT

A circulating fluidized bed boiler is described, comprising a furnace, a loopseal, and a loopseal heat exchanger arranged in the loopseal. The loopseal heat exchanger comprises walls limiting an interior of the loopseal heat exchanger, a first particle outlet for letting out particulate material from the loopseal heat exchanger, an inlet for receiving bed material, heat exchanger tubes arranged in the interior of the loopseal heat exchanger, and a first ash removal channel configured to let out ash from the loopseal heat exchanger. An ash cooler is configured to receive ash from the first ash removal channel. In the loopseal heat exchanger the first ash removal channel is arranged at a lower level than the first particle outlet.

17 Claims, 6 Drawing Sheets

(51) Int. Cl.

| | |
|---|---|
| ***F23C 10/04*** | (2006.01) |
| ***F23C 10/26*** | (2006.01) |
| ***F23C 10/06*** | (2006.01) |
| ***F23C 10/20*** | (2006.01) |
| ***F22B 37/10*** | (2006.01) |
| ***F28D 13/00*** | (2006.01) |
| ***F23J 1/00*** | (2006.01) |
| ***F23J 11/02*** | (2006.01) |

(52) U.S. Cl.

CPC ..... *F23C 10/04* (2013.01); *F23C 10/06* (2013.01); *F23C 10/20* (2013.01); *F23C 10/26* (2013.01); *F23J 1/00* (2013.01); *F23J 11/02* (2013.01); *F28D 13/00* (2013.01); *F22B 37/10* (2013.01); *F23C 2206/10* (2013.01); *F23C 2206/103* (2013.01); *F23J 2700/001* (2013.01)

(56) References Cited

U.S. PATENT DOCUMENTS

| | | | | |
|---|---|---|---|---|
| 5,095,854 | A | 3/1992 | Dietz | |
| 5,133,943 | A | 7/1992 | Abdulally | |
| 5,141,708 | A | 8/1992 | Campbell, Jr. et al. | |
| 5,184,671 | A | 2/1993 | Alliston et al. | |
| 5,624,469 | A | 4/1997 | Isaksson et al. | |
| 6,230,633 | B1 | 5/2001 | Magaldi et al. | |
| 7,240,639 | B2 * | 7/2007 | Hyppanen | F22B 31/0084 122/4 D |
| 9,423,122 | B2 * | 8/2016 | Kauppinen | F22B 31/003 |
| 10,293,378 | B2 * | 5/2019 | She | B07B 4/08 |
| 10,429,064 | B2 * | 10/2019 | Chiu | F23C 10/10 |
| 2006/0000425 | A1 * | 1/2006 | Kokko | F23C 10/18 122/4 D |
| 2009/0242377 | A1 | 10/2009 | Honkola et al. | |
| 2010/0000474 | A1 * | 1/2010 | Petanen | F22B 37/107 122/367.1 |
| 2011/0265697 | A1 * | 11/2011 | Sellakumar | F23C 10/10 110/345 |
| 2012/0237883 | A1 * | 9/2012 | Klajny | F23C 10/10 431/7 |
| 2014/0102342 | A1 * | 4/2014 | Maryamchik | F23C 10/10 110/245 |
| 2016/0201898 | A1 * | 7/2016 | Li | F23C 10/18 431/5 |
| 2016/0258692 | A1 * | 9/2016 | Kainu | F22B 37/06 |

FOREIGN PATENT DOCUMENTS

| | | | |
|---|---|---|---|
| JP | H05-071708 | A | 3/1993 |
| JP | H05-346202 | A | 12/1993 |

OTHER PUBLICATIONS

International Search Report and Written Opinion, dated Feb. 7, 2017, for PCT Application No. PCT/FI2016/050760, pp. 1-11.

International Preliminary Report on Patentability, dated Jan. 17, 2019, for PCT Application No. PCT/FI2016/050760, pp. 1-33.

Office Action for Japanese Patent Application No. 2019-522422, dated Nov. 5, 2019, (9 pages), Japanese Patent Office.

* cited by examiner

CIRCULATING FLUIDIZED BED BOILER WITH A LOOPSEAL HEAT EXCHANGER

CROSS REFERENCE TO RELATED APPLICATIONS

This application is a National Stage Application, filed under 35 U.S.C. § 371, of International Application No. PCT/FI2016/050760, filed Nov. 1, 2016; the contents of which as are hereby incorporated by reference in their entirety.

BACKGROUND

Related Field

The invention relates to circulating fluidized bed boilers. The invention relates to loopseal heat exchangers. The invention relates to particle coolers.

Description of Related Art

A fluidized bed heat exchanger is known from U.S. Pat. No. 5,184,671. The fluidized bed heat exchanger may be arranged in connection with a steam generator to recover heat from the bed material of the fluidized bed. Typically in such a heat exchanger steam becomes superheated, whereby such a fluidized bed heat exchanger may be referred to as a fluidized bed superheater. In a circulating fluidized bed boiler, a fluidized bed heat exchanger may be arranged in the loopseal. In such a case the heat exchanger may be referred to as a loopseal heat exchanger or a loopseal superheater.

The bed material of a fluidized bed boiler comprises inert particulate material and ash. In known solutions, all the bed material (i.e. also the ash) is conveyed from the loopseal heat exchanger to the furnace of the fluidized bed boiler, from which the ash can be collected as bottom ash. However, some of the ash may form agglomerates that hinder the operation of the fluidized bed reactor. The ash or the agglomerates may, for example, limit the air flow from a grate of a furnace, which results in uneven air flow in the furnace. In addition to affecting the operation of furnace, because of the ash, the pipelines need to be designed sufficiently large to convey also the ash. This may limit the capacity of the boiler.

BRIEF SUMMARY

To address these issues, a circulating fluidized bed boiler according to an embodiment of the invention comprises a loopseal heat exchanger comprising a first particle outlet for letting out particulate material from the loopseal heat exchanger and a first ash removal channel for letting out ash from the loopseal heat exchanger. Moreover, in order to sieve the bed material such that the ash content is larger in the first ash removal channel than at the first particle outlet, the first ash removal channel is arranged at a lower level than the first particle outlet. Thus, the heavy ash declines towards the first ash removal channel naturally by means of gravity. In a preferred embodiment, the loopseal heat exchanger comprises nozzles for fluidizing the bed material within the loopseal heat exchanger. By fluidizing the bed material, the loopseal heat exchanger functions also as an air sieve to help separating the heavy ash from the particulate material. Thus, the ash, or at least mainly the ash, can be removed from the loopseal heat exchanger and conveyed to a cooler for further processing instead of the furnace of the circulating fluidized bed boiler.

The invention is more specifically disclosed in the independent claim. The dependent claims and the description below disclose embodiments, of which some are preferred.

To illustrate different views of the embodiments, three orthogonal directions Sx, Sy, and Sz are indicated in the figures. The direction Sz is substantially vertical and upwards. In this way, the direction Sz is substantially reverse to gravity.

DETAILED DESCRIPTION OF VARIOUS EMBODIMENTS

Figure 1:
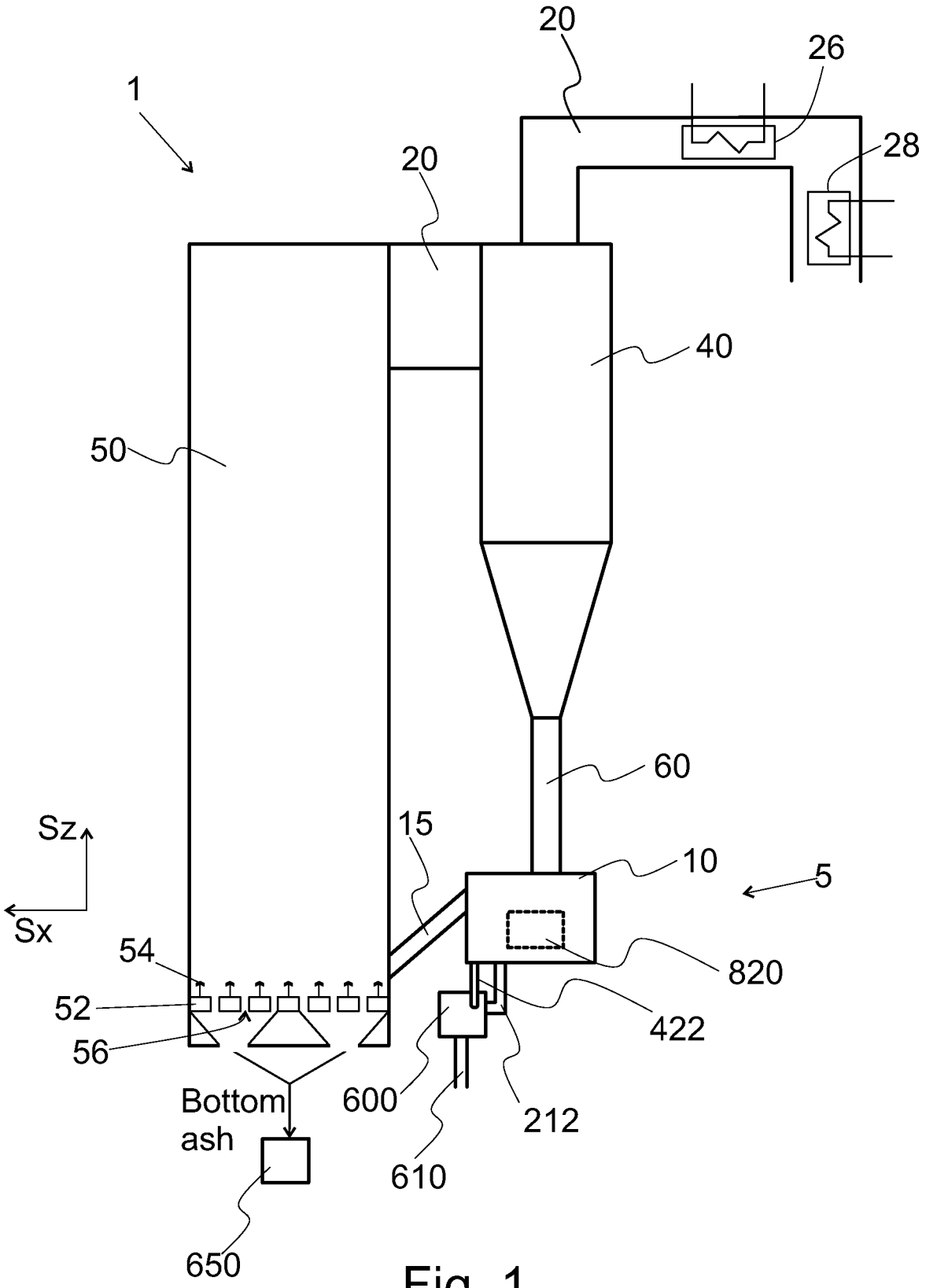
FIG. 1 shows a circulating fluidized bed boiler in a side view.

FIG. 1 shows a circulating fluidized bed boiler 1 in a side view. The circulating fluidized bed boiler 1 comprises a furnace 50, a cyclone 40, and a loopseal 5. In FIG. 1, flue gas channels are indicated by the reference number 20. Typically, the boiler 1 comprises heat exchangers 26, 28 within a flue gas channel 20, the heat exchangers 26, 28 being configured to recover heat from flue gases. Some of the heat exchangers may be superheaters 26 configured to superheat steam. Some of the heat exchangers may be economizers 28 configured to heat and/or boil water.

Within the furnace 50, some burnable material is configured to be burned. Some inert particulate material, e.g. sand, is also arranged in the furnace 50. The mixture of the particulate material and the burnable material and/or ash is referred to as bed material. At the bottom of the furnace 50, a grate 52 is arranged. The grate 52 is configured to supply air into the furnace in order to fluidize the bed material and to burn at least some of the burnable material to form heat, flue gas, and ash. In a circulating fluidized bed, the air supply is so strong, that the bed material is configured to flow upwards in the furnace 50. The grate 52 comprises grate nozzles 54 for supplying the air. The grate 52 limits bottom ash channels 56 for removing ash from the furnace 50.

From the upper part of the furnace 50, the bed material is conveyed to a cyclone 40 in order to separate the bed material from gases. From the cyclone 40, the bed material falls through a channel 60 to a loopseal 5. In the loopseal 5, a layer of bed material is formed. The layer prevents the combustion air or the fluidizing air from flowing in an opposite direction from the furnace 50 to the cyclone 40. Preferably, the loopseal 5 does not have a common wall with the furnace 50. This gives more flexibility to the structural design of the boiler 1. At least when the loopseal 5 does not have a common wall with the furnace 50, the bed material is returned from the loopseal 5 to the furnace 50 via a pipeline 15 configured to convey bed material from the loopseal 5 to the furnace 50.

Referring to FIG. 1, a loopseal heat exchanger 10 is arranged in the loopseal 5. Referring to FIGS. 2*a* to 5, the loopseal heat exchanger 10 comprises walls 500, some of which are vertical walls 505. Typically the walls 500 are formed of heat transfer tubes, which are configured to recover heat from the bed material. The walls 500 limit an interior 11 of the loopseal heat exchanger.

The walls 500 of the loopseal heat exchanger 10 limit (i.e. the loopseal heat exchanger has) a first particle outlet 590, which is configured to let out at least particulate material from the loopseal heat exchanger 10. The first particle outlet is limited from below by an outlet wall 507. In the FIGS. 2*b* and 3, the outlet wall 507 is vertical. The first particle outlet 590 is configured to let out at least particulate material from the interior 11 of the loopseal heat exchanger to the exterior thereof, such as to the pipeline 15. In addition to particulate material, some light ash may be conveyed to the pipeline 15 through the first particle outlet 590. Also some heavy ash may be conveyed along the particulate material; however, because of a sieving effect of the loopseal heat exchanger 10, most of heavy ash becomes separated and expelled through a first ash removal channel (211, 421, 431). Moreover, because of the sieving effect, the material removed via the first ash removal channel (211, 421, 431) comprises mainly ash. For example, the material removed via the first ash removal channel (211, 421, 431) comprises ash to a greater extent than the material removed via the first particle outlet 590.

The walls 500 of the loopseal heat exchanger limit (i.e. the loopseal heat exchanger has) a first compartment 21. The first compartment 21 comprises an inlet 31 for receiving bed material from the furnace 50 via the cyclone 40.

In the embodiment of FIGS. 2*a* to 5, the walls 500 of the loopseal heat exchanger limit (i.e. the loopseal heat has) a second compartment 22. The second compartment 22 comprises heat exchanger tubes 820 (see FIG. 2*b*) configured to recover heat from bed material within the loopseal 5. The heat exchanger tubes 820 (within the second compartment 22) and the heat transfer tubes (of the walls) may be similar.

In an embodiment, a lower edge of the first particle outlet 590 is arranged at a higher vertical level than at least some of the heat exchanger tubes 820, which are arranged in the interior 11 of the loopseal heat exchanger 10. This has the effect that, in use, at least some of the heat exchanger tubes 820 are arranged in a bed of particulate material, since the first particle outlet 590 defines the surface of the bed of particulate material within the loopseal heat exchanger 10. Preferably, a lower edge of the first particle outlet 590 is arranged at a higher vertical level than at least half of the heat exchanger tubes that are arranged in the interior 11 of the loopseal heat exchanger 10. More preferably, a lower edge of the first particle outlet 590 is arranged at a higher vertical level than all the heat exchanger tubes that are arranged in the interior 11 of the loopseal heat exchanger 10.

A first wall 510 of the walls 500 separates the first compartment 21 from the second compartment 22. The first wall 510 may be a vertical wall 505. In an embodiment, the first wall 510 extends from the bottom of the first compartment 21 and/or the bottom of the second 22 compartment upwards. By having different compartments, a gas lock may arranged locally near the inlet 31 as will be detailed below. The first wall 510 may be planar. At least a part of the first wall 510 may be common to the first compartment 21 and the second compartment 22. Thus, in an embodiment, a part of the first wall 510 limits both the first compartment 21 and the second compartment 22. More specifically, a part of the first wall 510 limits the first compartment 21 and the same part of the first wall 510 limits also the second compartment 22.

As for the terms used throughout this description, unless otherwise specified, two different compartments (21, 22) are separated by a wall 500 that extends from the bottom of both the compartments upwards (21, 22). Preferably, the bottom of the first compartment 21 is located at the same vertical level as the bottom of the second compartment 22. Preferably, the ceiling of the first compartment 21 is arranged at the same vertical level as the ceiling of the second compartment 22. In case the bottoms are located at different heights, compartments (21, 22) are separated by a wall that extends from the bottom of the lower compartment upwards to the bottom of the higher compartment. The wall may extend even further upwards. However, as indicated e.g. in FIGS. 4 and 5, typically a channel 512 is left in between the (lower) top of the compartments and an upper edge of the wall, e.g. the first wall 510.

Figure 4:
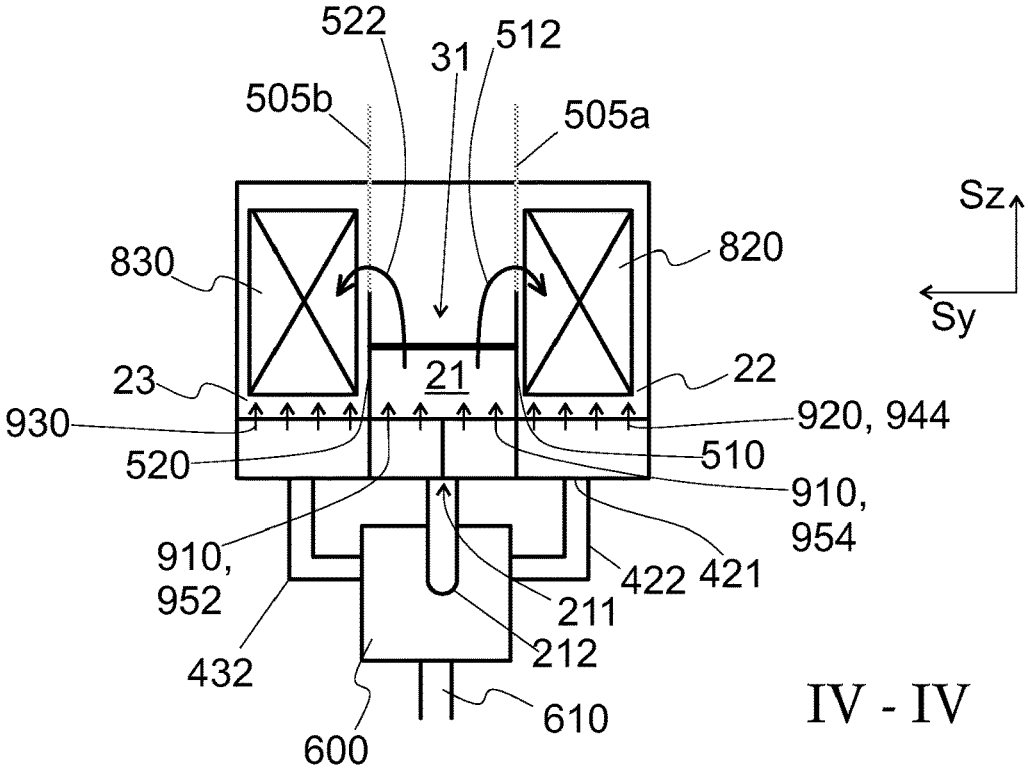
FIG. 4 shows the sectional view IV-IV of the loopseal heat exchanger of FIG. 2*b*, the section III-Ill indicated in FIG. 2*b*.
Figure 5:
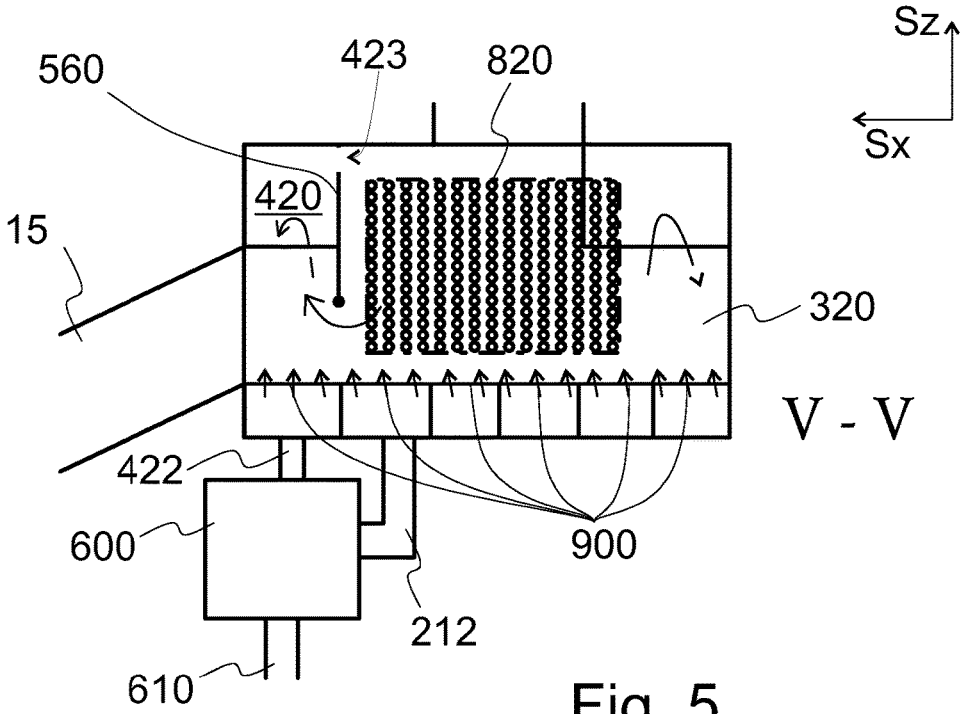
FIG. 5 shows the sectional view V-V of the loopseal heat exchanger of FIG. 2*b*, the section III-Ill indicated in FIG. 2*b*.

The first wall limits 510 (e.g. from below and/or from top) a first channel 512 for conveying bed material. In FIGS. 2*a* to 5, the first channel 512 is configured to convey bed material from the first compartment 21 to the second compartment 22. The first channel 512 may be limited e.g. by a first wall 510 extending from the top of the first compartment 21 and/or the top of the second compartment 22 downwards for a distance less than the height of the compartments. Thus, such a first channel 512 would be located in between [i] the bottom of the first compartment and/or the bottom of the second compartment and [ii] the lower edge of the first wall. As indicated in FIGS. 4 and 5, the first channel 512 may be limited e.g. by a first wall 510 extending from the bottom of the first compartment 21 and/or the bottom of the second compartment 22 upwards for a distance less than the height of the compartments. Thus, such a first channel would be located in between [i] the top of the first compartment and/or the top of the second compartment and [ii] the upper edge of the first wall. The first channel 512 may also be an orifice limited by a first wall 510 that extends laterally to all directions from the orifice.

The loopseal heat exchanger 10 further comprises a first ash removal channel (211, 421) configured to convey ash out of the first compartment 21 or the second compartment 22. Preferably, the first ash removal channel (211, 421) is configured to convey ash from the bottom of the first compartment 21 or from the bottom of the second compartment 22. This has the effect that ash will not accumulate within the loopseal heat exchanger 10, which improves the heat recovering capacity of the loopseal heat exchanger 10. In the alternative, the first ash removal channel (211, 421) may be arranged in a vertical wall of the loopseal heat exchanger. However, for purposes of emptying the loopseal heat exchanger for maintenance, a lower edge of the first ash removal channel is preferably located at most 50 cm above the bottom of the loopseal heat exchanger 10.

Moreover, the first ash removal channel (211, 421) is arranged at a lower level than the first particle outlet 590. As indicated above, in such an arrangement, the loopseal heat exchanger 10 functions as a sieve separating heavy ash from particulate material. The heavy ash can then be collected from the bottom of the first or the second compartment (21, 22) to the first ash removal channel (211, 421). When the bed material in the loopseal heat exchanger 10 is fluidized, the loopseal heat exchanger 10 furthermore functions as an air sieve, which even more effectively separates the heavy ash from the particulate material. The first ash removal channel (211, 421) may be arranged relative to the first particle outlet 590 such that a top edge of the first ash removal channel (211, 421) is arranged at a lower level than a lower edge of the first particle outlet 590. The term "lower level" refers to a vertical level, i.e. a vertical position.

In an embodiment, a top edge of the first ash removal channel (211, 421) is arranged at a lower level than a lower edge of the first particle outlet 590. In an embodiment, a top edge of the first ash removal channel (211, 421) is arranged at least 50 cm or at least 1 m lower than a lower edge of the first particle outlet 590. In an embodiment, a lower edge of the first particle outlet 590 is arranged at least 1.5 m or at least 2 m above the bottom of the loopseal heat exchanger. Correspondingly, in an embodiment, a lower edge of the first particle outlet 590 is arranged at least 1 m or at least 1.5 m above an upper edge of the first ash removal channel (211, 421).

In an embodiment, the first ash removal channel 211 is configured to let out ash from the first compartment 21. As indicated above, in an embodiment, the first wall 510 extends from the bottom of the second compartment upwards. In such an embodiment, the first wall 510 may hinder the flow of ash from the second compartment 22 to the first compartment 21. Therefore, at least in such an embodiment, the loopseal heat exchanger preferably comprises a second ash removal channel 421 configured to let out ash from the second compartment 22. Preferably the second ash removal channel 421 is configured to let out ash from a bottom of the second compartment 22. The second ash removal channel 421 may be arranged in a vertical wall of the loopseal heat exchanger. In an embodiment, the second ash removal channel 421 is arranged at a lower level than the first particle outlet 590. The second ash removal channel 421 may be arranged relative to the first particle outlet 590 such that a top edge of the second ash removal channel 421 is arranged at a lower level than a lower edge of the first particle outlet 590. As for the vertical distances between the first particle outlet 590 and the second ash removal channel 421, the same distances apply as recited above for the first particle outlet 590 and the first ash removal channel 211. As for the vertical position of the second ash removal channel 421 relative to the bottom of the loopseal heat exchanger, the same distance apply as recited above for the first ash removal channel 211.

Referring to FIGS. 6 to 9*b*, and as will be detailed below, the flow of bed material is typically directed from an inlet 31 to the first particle outlet 590 via (at least one) heating chamber 320 and/or via a bypass chamber 200. The bed material may have a specified flow direction only, whereby ash might be hard to discharge using only a single ash removal channel. Thus, in an embodiment, the first ash removal channel 211 is configured to let out ash from a bypass chamber 200 of the loopseal heat exchanger 10. What has been said above about the vertical position of the first ash removal channel 211 relative to the first particle outlet 590 applies also in this embodiment. Moreover, also in these embodiments, the loopseal heat exchanger 10 preferably comprises a second ash removal channel 421 configured to let out ash from the heating chamber 320. What has been said above about the vertical position of the second ash removal channel 421 relative to the first particle outlet 590 applies also in this embodiment.

Figure 2A:
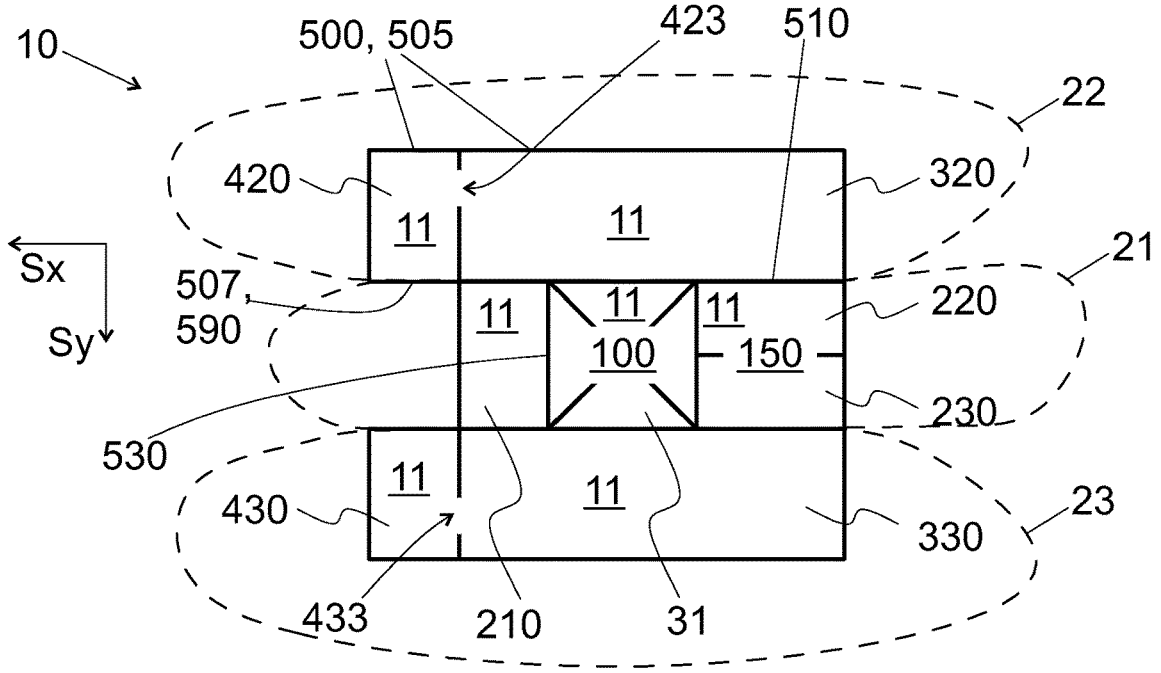
FIG. 2*a* shows different chambers of a loopseal heat exchanger according to a first embodiment in a top view.
Figure 2B:
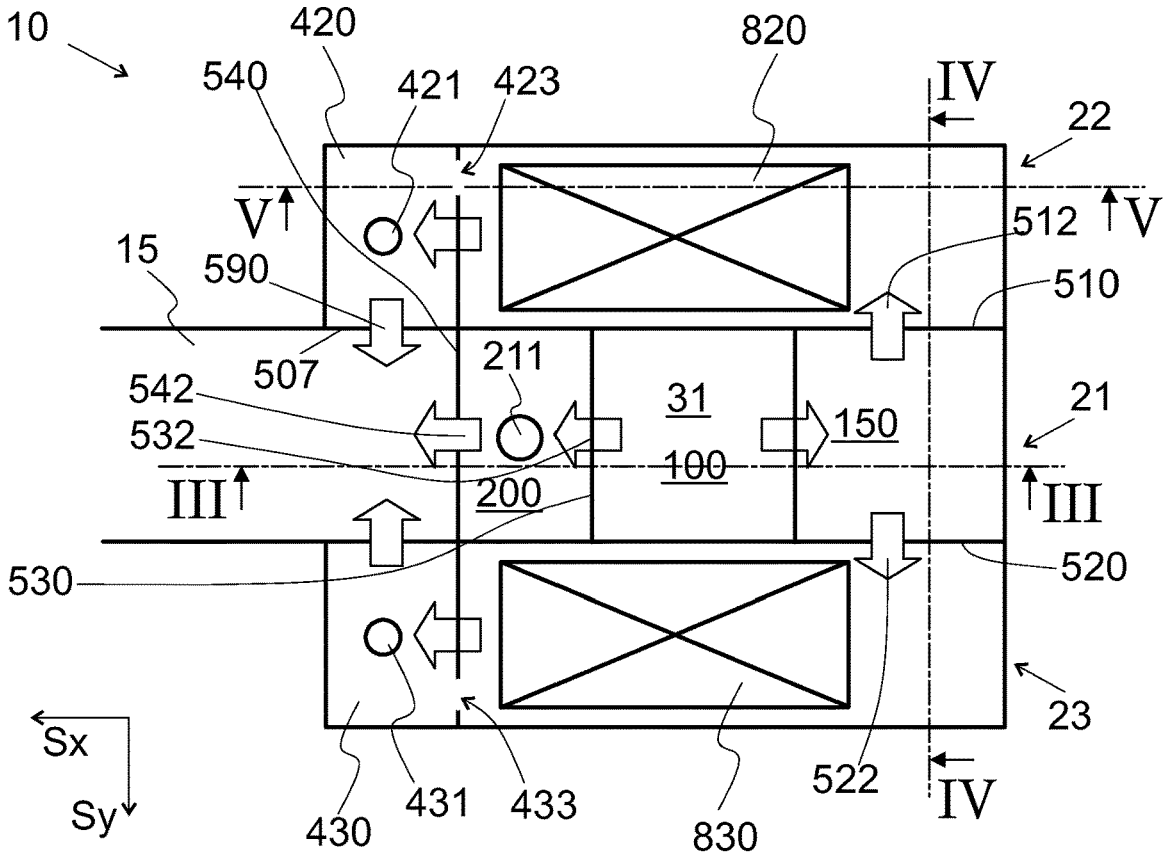
FIG. 2*b* shows a cross section of the loopseal heat exchanger of FIG. 2*a* in a top view.

As indicated in FIG. 2*a*, the inlet 31 for receiving bed material may be configured to feed bed material to the second compartment 22 equipped with heat transfer tubes 820. Moreover, the inlet 31 for receiving bed material may be configured to feed bed material to a third compartment 23 equipped with heat transfer tubes 830. This makes the structure compact, since it allows for a lot of heat exchanger surfaces to be used for a single particle inlet 31. Thus, in an embodiment, the walls 500 of the loopseal heat exchanger 10 limit (i.e. the loopseal heat exchanger 10 has) a third compartment 23. Some heat exchanger tubes 830 configured to recover heat from bed material within the loopseal 5 are arranged also in the third compartment 23, i.e. in the interior thereof. As indicated in FIGS. 2*a* and 2*b*, the particle inlet 31 may be arranged in between the second compartment 22 and the third compartment 23. Moreover, a second wall 520 of the walls 500 of the loopseal heat exchanger separate the third compartment 23 from the first compartment 21. The second wall 520 limits a second channel 522 for conveying bed material from the first compartment 21 to the third compartment 23. What has been said about the first wall 510 and the first channel 512 applies to the second wall 520 and second channel 522 mutatis mutandis.

As indicated above in connection with the first wall 510, depending on the structure of the second wall 520, the ash may not, in all cases, be able to flow from the third compartment 23 to the first compartment 21. Therefore, in an embodiment the loopseal heat exchanger 10 comprises a third ash removal channel 431 configured to let out ash from the third compartment 23. The third ash removal channel 431 may be configured to let out ash from the bottom of the third compartment 23. The third ash removal channel 431 may arranged at a lower level than the first particle outlet 590 in the same sense as discussed above for the first ash removal channel 211. As for the vertical distance between the first particle outlet 590 and the third ash removal channel 431, the same distances apply as recited above for the first particle outlet and the first ash removal channel.

When the ash is removed from the loopseal heat exchanger 10, and as indicated above, the ash in preferably not conveyed into the furnace 50 of the fluidized bed boiler 1. Since the ash is hot, it contains recoverable heat. Thus, in a preferred embodiment, the circulating fluidized bed boiler 1 comprises an ash cooler 600 (FIGS. 3 to 5 and 9*a* and 9*b*). The ash cooler 600 is configured to receive ash from at least the first ash removal channel 211. The ash cooler 600 may be configured to receive ash from the first ash removal channel 211 through a pipeline 212 that is not connected to the furnace 50 of the fluidized bed boiler 1. It is economically feasible to use the same ash cooler 600 for all the ash that is let out from the loopseal heat exchanger 10. Thus, preferably, the ash removal channels (the first 211 and optionally the second 421 and the third 431) are arranged relative to each other in such a way that the ash cooler 600 is configured to receive ash from the ash removal channels. The ash cooler 600 is arranged relative to the ash removal channels (the first 211 and optionally the second 421 and the third 431) in a similar manner. The ash cooler 600 may be configured to receive ash from the second ash removal channel 421 through a pipeline 422. The ash cooler 600 may be configured to receive ash from the third ash removal channel 431 through a pipeline 432.

Moreover, preferably the ash cooler 600 is configured to receive bed material only from the loopseal 5 of the fluidized bed boiler 1. Preferably the ash cooler 600 is configured to receive bed material only from loopseal heat exchanger(s) of the fluidized bed boiler 1. Preferably the ash cooler 600 is configured to receive bed material only from that loopseal heat exchanger 10 that comprises the first ash removal channel 211. Moreover, the ash cooler 600 is configured to receive bed material from the loopseal heat exchanger 10 such that the ash is not conveyed via the furnace 50 from the loopseal heat exchanger 10 to the ash cooler 600. The ash cooler 600 may include a heat transfer medium circulation for recovering heat from the ash. The ash cooler 600 may comprise a screw conveyor. The ash cooler 600 may comprise a screw conveyor, wherein the screw conveyor is equipped with a circulation of cooling medium, such a water.

In an embodiment, the system comprises another ash cooler 650 configured receive bottom ash from the furnace 50 and to cool the bottom ash received from the furnace 50. The other ash cooler 650 may include a heat transfer medium circulation for recovering heat from the ash. The other ash cooler 650 may comprise a water-cooled screw conveyor, as indicated above.

To enhance the flow of bed material within the loopseal heat exchanger 10, the loopseal heat exchanger comprises nozzles 900 (see FIG. 4). The nozzles 900 are configured to fluidize the bed material within the loopseal heat exchanger 10 by conveying fluidizing gas into the loopseal heat exchanger 10. The nozzles are arranged at a bottom of the loopseal heat exchanger 10.

In an embodiment, some first nozzles 910 of the nozzles 900 are configured to drive ash towards the first ash removal channel 212 by a flow of the fluidizing gas. The first nozzles 910 may be arranged to direct the flow of fluidizing air into a direction. The direction may be e.g. substantially vertical, or the direction may form an angle of at most 60 degrees with the vertical, to fluidize the bed material. To drive ash, the projection of the direction of the flow of fluidizing air onto a horizontal plane has a non-zero length. Moreover the direction of the projection indicates the direction to which the ash is driven. Such a guiding may be obtained e.g. when at least a nozzle 900 is not axially symmetric about a vertical axis. The nozzle may be axially symmetric such that the axis of symmetry is tilted towards the first ash removal channel 212 (see FIG. 3). In such cases, the first nozzles 910 can be used to guide the ash towards or mainly towards the ash removal channel 212. The first nozzles may be arranged within the first compartment 21.

In an embodiment where the loopseal heat exchanger 10 comprises the second ash removal channel 421, at least some second nozzles 920 of the nozzles 900 are configured to drive ash towards, or mainly towards, the second ash removal channel 421 by a flow of the fluidizing gas. Provided that the loopseal heat exchangers has a second compartment, the second nozzles 920 may be arranged within the second compartment 22. What has been said about the shape and orientation of the first nozzles 910 applies to second nozzles 920 mutatis mutandis.

Moreover, when the loopseal heat exchanger comprises the third ash removal channel 431, at least some third nozzles 930 of the nozzles 900 are preferably configured to drive ash towards the third ash removal channel 431 by a flow of the fluidizing gas. The third nozzles 930 may be arranged within the third compartment 23. What has been said about the shape and orientation of the first nozzles 910 applies to third nozzles 930 mutatis mutandis.

Figure 3:
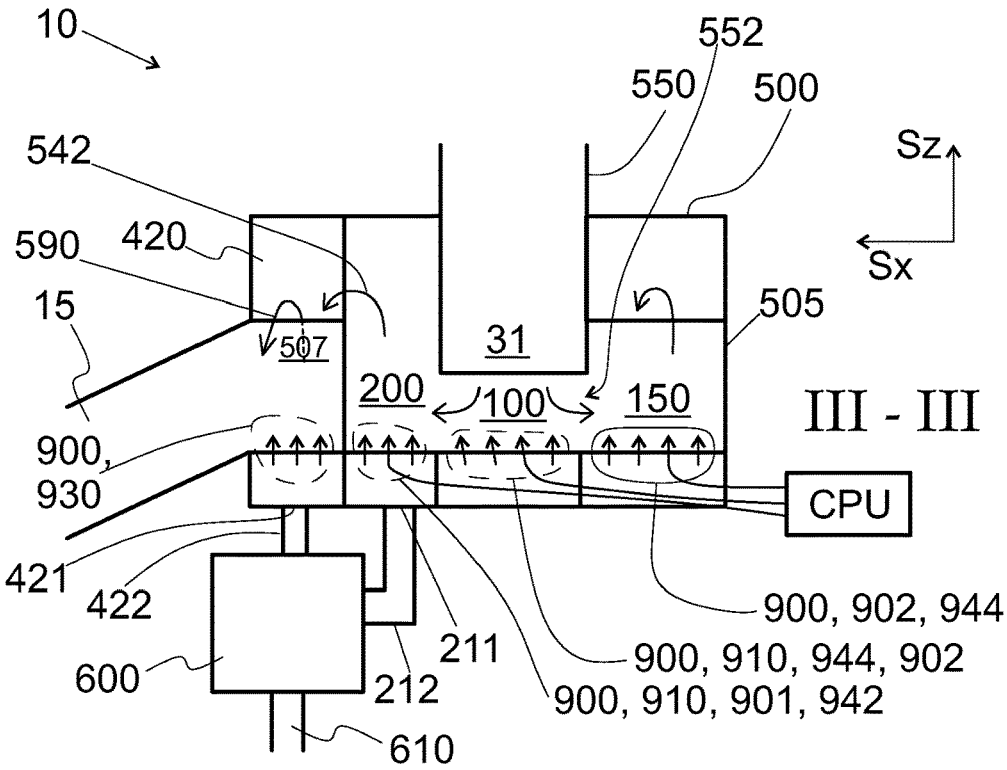
FIG. 3 shows the sectional view III-Ill of the loopseal heat exchanger of FIG. 2*b*, the section III-Ill indicated in FIG. 2*b*.

Referring to FIGS. 2*a*, 2*b*, and 3, an embodiment of the loopseal heat exchanger comprises a third wall 530. The third wall 530 divides the first compartment 21 to an inlet chamber 100 and a bypass chamber 200, the inlet chamber 100 comprising the inlet 31 for receiving bed material from the furnace 50 via the pipeline 60. The third wall 530 is one of the walls 500 of the loopseal heat exchanger 10. The third wall 530 limits (e.g. from above) a third channel 532 for conveying bed material from the inlet chamber 100 to the bypass chamber 200. As indicated in FIG. 3, the third wall 530 may be a wall extending from the top of the first compartment 21 downwards. The embodiment further comprises a fourth wall 540 limiting the bypass chamber 200. The fourth wall 540 limits (e.g. from below) also a second particle outlet 542 for letting out particulate material from the loopseal heat exchanger 10. The inlet chamber 100 may be referred to as a dipleg 100. The flow of material in the dipleg 100 may be substantially downwards. Typically, some bed material is arranged in the pipeline 60 (see FIG. 1), whereby the pressure of the bed material drives the bed material downwards in the inlet chamber 100. The bypass chamber 200 may be referred to as a bypass upleg 200. The flow of material in the bypass upleg 200 may be substantially upwards.

Preferably, the third channel 532 and the second particle outlet 542 are configured such that a lower edge of the second particle outlet 542 is located at a higher vertical level than an upper edge of the third channel 532. Because of this difference in the vertical level, in use, a reasonably thick layer of bed material exists within the bypass chamber 200. This layer forms a first gas lock such that the fluidizing gas of the furnace does not flow in the wrong direction. More preferably, the third channel 532 and the second particle outlet 542 are configured such that a lower edge of the second particle outlet 542 is located at least 500 mm, such as from 500 mm to 700 mm, higher than an upper edge of the third channel. This height of the bed material in the first gas lock has been found to be suitable in practical industrial applications.

As for the terms used throughout this description, unless otherwise specified, two different chambers are separated by a wall that extends from the ceiling of both the chambers downwards. In case the ceilings are located at different heights, chambers are separated by a wall that extends from the ceiling of the higher-located chamber downwards to the ceiling of the lower-located chamber. The wall may extend even further downwards. However, as indicated e.g. in FIG. 5, typically a channel is left in between the bottom of the chambers and a lower edge of the wall.

Except for the walls 500, the bypass chamber 200 may be free from heat exchanger tubes. In principle, also a wall 500 or walls of the bypass chamber 200 may be free from heat exchanger tubes. The bypass chamber 200 can be used to bypass the heat exchanger tubes 820 of the second compartment 22. The bypass chamber 200 can be used to bypass the heat exchanger tubes 830 of the third compartment 23. In effect, the bypass chamber 200 may be used to convey bed material through the loopseal heat exchanger 10 by recovering at most only a little heat from the bed material.

As for the flow of bed material through the second compartment 22, referring to FIG. 3, in an embodiment the loopseal heat exchanger comprises 10 a fifth wall 550 dividing the first compartment 21 to an inlet chamber 100 and a feeding chamber 150. The fifth wall 550 may extend from the top of the first compartment 21 downwards. As indicated in FIG. 4, aforementioned first wall 510 separates the feeding chamber 150 from the second compartment 22.

The feeding chamber 150 may be referred to as a feeding upleg 150. In the feeding upleg 150, the flow of bed material may be substantially upwards, as indicated in FIGS. 3 and 4. As for the walls of FIG. 4, the first wall 510 and the second wall 520 of the feeding chamber 150 are indicated by black colour. However, in the positive Sx-direction (see FIG. 2*b*) these walls also extend as walls of the inlet chamber 100. These parts of the walls, i.e. the upper parts, are indicated by grey colour in FIG. 4. These walls may extend in the positive Sx direction also as the walls of the bypass chamber 200.

When the loopseal heat exchanger comprises the fifth wall 550 limiting the inlet chamber 100, the fifth wall 550 limits a fifth channel 552 for conveying bed material from the inlet chamber 100 to the feeding chamber 150. As indicated above, the first wall 510 limits the first channel 512 for conveying bed material from the first compartment 21 to the second compartment 22. By arranging the first 512 and the fifth 552 channels such that the first channel 512 is at a higher vertical level than the fifth channel 552, the feeding chamber 150 forms a second gas lock. Also the second gas lock prevents the air of the furnace from flowing in the wrong direction. Therefore, in an embodiment, the first channel 512 and the fifth channel 552 are configured such that a lower edge of the first channel 512 is located higher than an upper edge of the fifth channel 552. In this way, the feeding chamber forms the second gas lock. Preferably, the first channel 512 and the fifth channel 552 are configured such that a lower edge of the first channel is located at least 500 mm, such as from 500 mm to 700 mm, higher than an upper edge of the fifth channel. This height of the bed material in the second gas lock has been found to be suitable in practical industrial applications.

The flow of bed material within the loopseal heat exchanger 10 can be controlled by the degree of fluidization. To control the flow of bed material within the loopseal heat exchanger 10, the loopseal heat exchanger comprises a first group of nozzles 901 configured to fluidize bed material at a first location within the loopseal heat exchanger and second group of nozzles 902 configured to fluidize bed material at a second location within the loopseal heat exchanger, the second location being different from the first location. As is evident, the nozzles 901, 902 of the groups belong to the set of the nozzles 900. Air flow through the first group of nozzles 901 is controllable. Air flow through the second group of nozzles 902 is controllable. Moreover, air flow through also other nozzles 900 may be controllable.

To control the degree of fluidization in at least these two locations independently of each other, the circulating fluidized bed boiler comprises a control unit CPU configured to control the flow of air through the first group of nozzles 901 and control the flow of air through the second group of nozzles 902 independently of the flow of air through the first group of nozzles 901.

To control the flow of bed material within the bypass chamber 200, the loopseal heat exchanger comprises primary nozzles 942 (i.e. a first group of nozzles 901) arranged within the bypass chamber, as indicated in FIG. 3. The primary nozzles 942 are configured to fluidize bed material within the bypass chamber 200. The loopseal heat exchanger comprises secondary nozzles 944 (i.e. a second group of nozzles 902) arranged outside of the bypass chamber 200, but within the first 21 or the second 22 compartment. The secondary nozzles 944 are configured to fluidize bed material on top of their position. The secondary nozzles 944 may be arranged e.g. in the inlet chamber 100 (FIG. 3). The secondary nozzles 944 may be arranged e.g. in the second compartment 22 (FIG. 4). The secondary nozzles 944 may be the aforementioned second nozzles 920 or some thereof.

To control the flow of bed material into the bypass chamber 200, the circulating fluidized bed boiler 1 comprises a control unit CPU configured to control [i] the flow of air through the primary nozzles 942 and [ii] the flow of air through the secondary nozzles 944 independently of the flow of air through the primary nozzles 942. As an example, when the primary nozzles are used to fluidize bed material and the secondary nozzles are not used to fluidize bed material, the easiest path for the bed material is through the bypass chamber. In this case, most of the bed material bypasses the heat exchanger tubes 820 of the second compartment 22. Conversely, when the primary nozzles are not used for fluidization, and the second nozzles are used, the bypass chamber poses strong flow resistance, and most bed material is flown through the second compartment.

The same idea can be used to control how the bed material is divided in between the second and third compartments. By controlling the flow of fluidizing gas through the nozzles, it is possible to affect the flow of the bed material within the loopseal heat exchanger.

As an example, when the second nozzles 920 are used to fluidize bed material and the third nozzles 930 are not used to fluidize bed material, the easiest path for the bed material is through the second compartment 22. In this case, the third compartment 23 is not used for recovering heat from bed material. Conversely, when the third nozzles 930 are used to fluidized bed material and the second nozzles 920 are not used to fluidize bed material, the easiest path for the bed material is through the third compartment 23. In this case, the second compartment 22 is not used for recovering heat from bed material.

In the alternative, a feeding chamber 150 may comprise nozzles for fluidizing the bed material in the feeding chamber 150. The nozzles of the feeding chamber 150 that are closer to the second compartment 22 than to the third compartment may be referred to as nozzles A 954 (see FIG. 4). The nozzles of the feeding chamber 150 that are closer to the third 23 compartment than to the second compartment 22 may be referred to as nozzles B 952. By controlling individually the amount of fluidization through the nozzles A and the nozzles B, it is possible to affect how much of the bed material is conveyed to the second compartment 22 and how much is conveyed to the third compartment 23. In an embodiment, the circulating fluidized bed boiler comprises a control unit CPU configured to control [i] the flow of air through the nozzles A 954 and [ii] the flow of air through the nozzles B 952 independently of the flow of air through the nozzles A 954.

As is evident, by locally controlling the fluidization, as indicated above, it is possible to affect the division ratios of the bed material. First, as indicated above, by using the primary 942 and secondary nozzles 944, one may control the amount of bed material bypassing the heat exchanger tubes 820, 830 relative to the amount of bed material received in the loopseal heat exchanger 10. Second, as indicated above, by using [i] the second 920 and third 930 nozzles or [ii] the nozzles A 954 and the nozzles B 952, one may control the amount of bed material entering the second compartment 22 relative to the total amount of bed material entering the second 22 and the third 23 compartment.

Also, as indicated in FIG. 5, the nozzles may be grouped to several regions to affect locally the flow of bed material within the second compartment 22.

Typically, the control of bed material flow within the loopseal of FIGS. 2*a* to 5 can be well controlled, provided that the flow or air in at least eight different regions can be individually controlled. The eight regions may be e.g.: the bypass chamber 200, the inlet chamber 100, a first half 220 of the feeding chamber 150 (FIG. 2*a*), the other half 230 of the feeding chamber 150, the heating chamber 320, the other heating chamber 330, the discharge chamber 420, and the other discharge chamber 430. In addition, as indicated above, the heating chambers may be divided to further sections each having individually controllable air flows. Thus, circulating fluidized bed boiler may comprise a control unit CPU configured to control the flow of air through a set of the nozzles 900 independently of the flow of air through the other nozzles of the set of nozzles. As indicated above, in this case, the set of nozzles may comprise at least eight nozzles, such as eight nozzles. An arrow in the FIGS. 2*a* to 9*b* indicate the direction of flow of bed material and/or fluidizing air. As evident to a skilled person, the arrows indicating nozzles (e.g. 900) indicate the direction of air flow from the nozzles. Correspondingly, the other arrows indicate the bed material flow and its direction.

As indicated in FIGS. 6 to 9*b*, an embodiment does not comprise walls limiting a feeding upleg 150. In contrast, bed material may be fed directly from the inlet chamber 100 to heat exchanger tubes 810, 820, 830. In such an embodiment, the loopseal heat exchanger 10 is not necessarily divided into at least two compartments in the aforementioned meaning. Correspondingly, already the first compartment 21 may comprise heat exchanger tubes 810.

Figure 6:
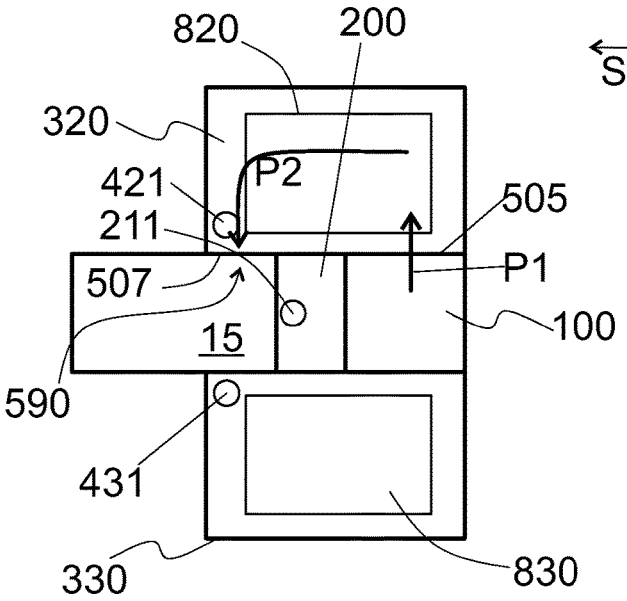
FIG. 6 shows different chambers of a loopseal heat exchanger according to a second embodiment in a top view.

As for the control of bed material flow within the loopseal of FIG. 6, the flow can be well controlled, provided that the flow or air at least four different regions can be individually controlled. Such regions are: the inlet chamber 100, the bypass chamber 200, the first heating chamber 320, and a second heating chamber 330. Thus, a circulating fluidized bed boiler may comprise a control unit CPU configured to control the flow of air through a set of the nozzles 900 independently of the flow of air through the other nozzles of the set of nozzles. As indicated above, in this case, the set of nozzles may comprise at least four nozzles, such as four nozzles. Naturally, each of the chambers may comprise many nozzles; however, the CPU may be configured to control the total flow of air through all the nozzles in a chamber, whereby the flow of air through a nozzle of a chamber may depend on the flow of air through another nozzles of the same chamber. The direction of bed material flow within the loopseal heat exchanger of FIG. 6 is: in the inlet chamber 100 substantially downwards, in the bypass chamber 200 substantially upwards, and in the heating chambers (320, 330) mainly horizontal, by also upwards, for example at some point near the pipeline 15.

Figure 7:
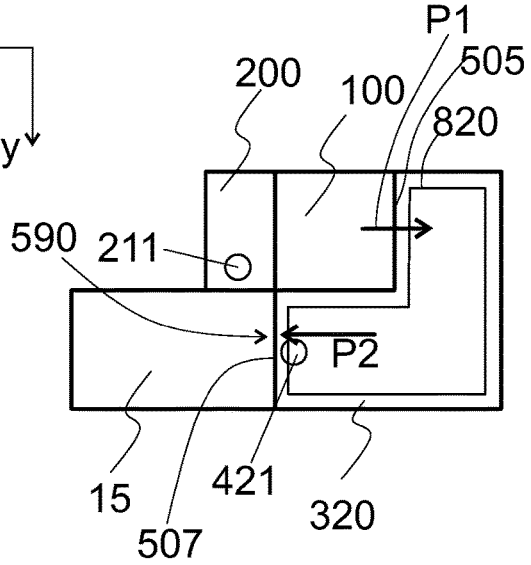
FIG. 7 shows different chambers of a loopseal heat exchanger according to a third embodiment in a top view.

As for the control of bed material flow within the loopseal of FIG. 7, the flow can be well controlled, provided that the flow or air in at least three different regions can be individually controlled. Such regions are: the inlet chamber 100, the bypass chamber 200, and the heating chamber 320. Thus, circulating fluidized bed boiler may comprise a control unit CPU configured to control the flow of air through a set of the nozzles 900 independently of the flow of air through the other nozzles of the set of nozzles. As indicated above, in this case, the set of nozzles may comprise at least three nozzles, such as three nozzles. The direction of bed material flow within the loopseal heat exchanger of FIG. 7 is: in the inlet chamber 100 substantially downwards, in the bypass chamber 200 substantially upwards, and in the heating chamber 320 mainly horizontal, by also upwards, for example at some point near the pipeline 15.

In this way, the embodiment of FIG. 6 or 7 may provide a cost-effective alternative for the embodiment described in FIGS. 2*a* to 5. Moreover, in the embodiment of FIGS. 6 to 9*b*, a gas lock or at least two gas locks may be formed by the walls of the loopseal heat exchanger 10.

Figure 8A:
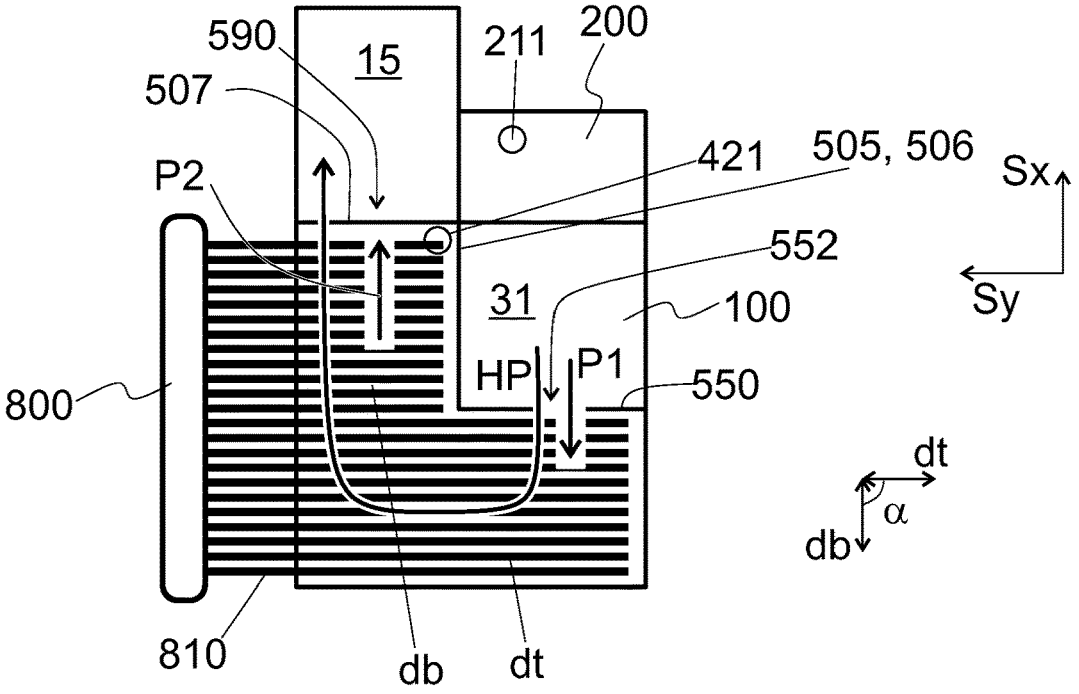
FIGS. 8*a* to 8*c* show arrangements of heat exchanger tubes in the loopseal heat exchanger of FIG. 7 in a top view.
Figure 8B:
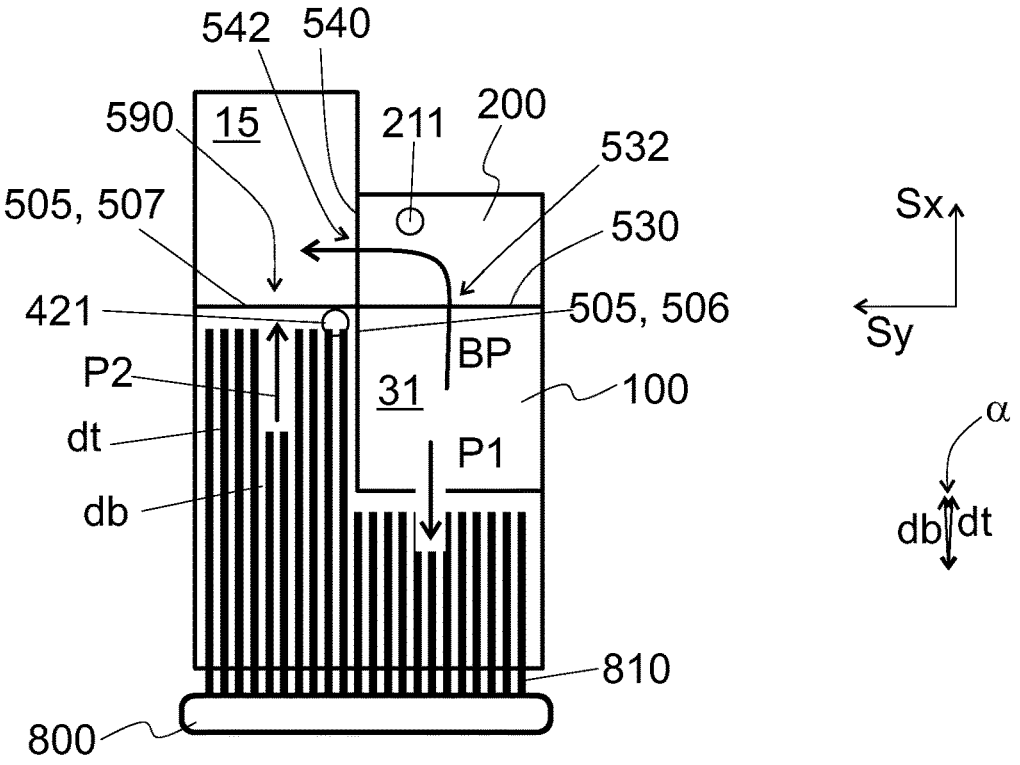

Referring to FIGS. 8*a* to 9*b*, in particular FIG. 8*b*, the loopseal heat exchanger 10 of those embodiments comprises [i] a third wall 530 that limits the inlet chamber 100 and a third channel 532, and [ii] a fourth wall 540 that limits the bypass chamber 200 and a second particle outlet 542. These walls 530, 540 further limit a bypass path BP through which the bed material is configured to flow from the inlet 31 to the pipeline 15 via the second particle outlet 542. The bypass path BP comprises the third channel 532 and the second particle outlet 542 (see also FIG. 2*b*). The fourth wall 540 is arranged downstream in the direction of bed material flow from the third wall 530. Moreover, to have a first gas lock formed by the bypass path BP, the third channel 532 may be arranged relative to the second particle outlet 542 at a lower level. What has been said above (in connection with FIG. 2*b*) about the mutual positioning of the channel 532 and the second particle outlet 542 in order to form a first gas lock, applies also in the embodiments of FIGS. 6 to 9*b*.

Figure 8C:
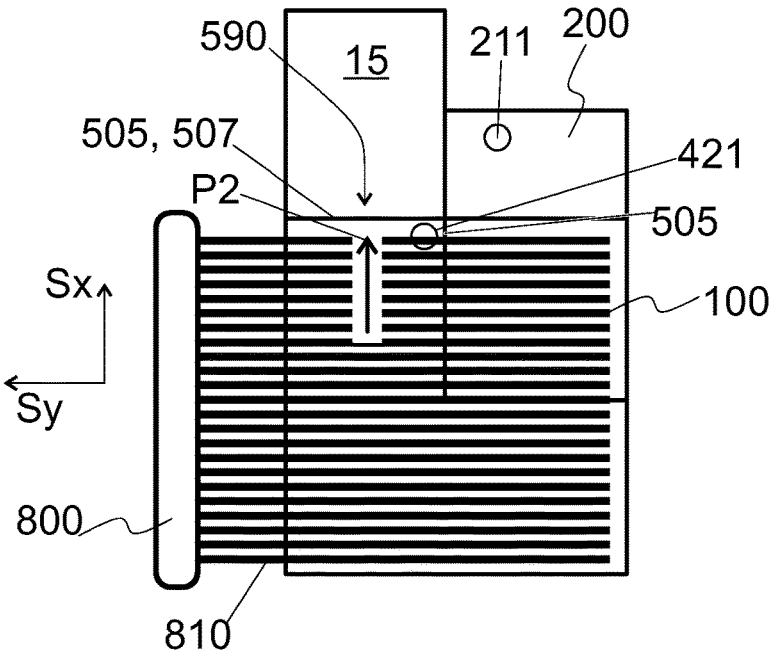
Figure 9A:
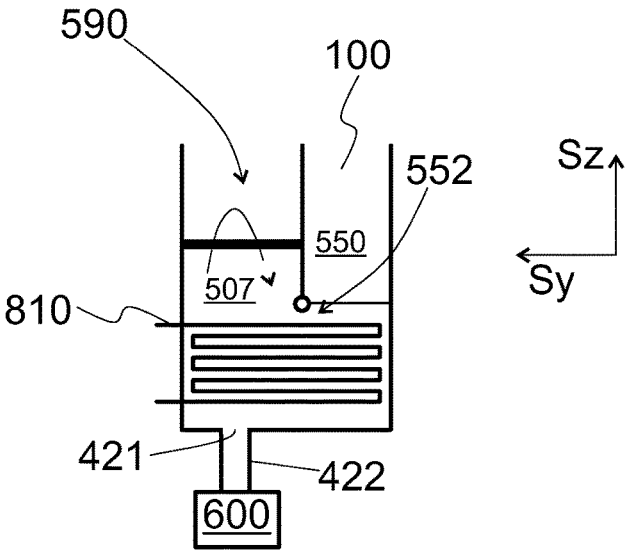
FIGS. 9*a* and 9*b* show arrangements of heat exchanger tubes in the loopseal heat exchanger of FIG. 7 in an end view.
Figure 9B:
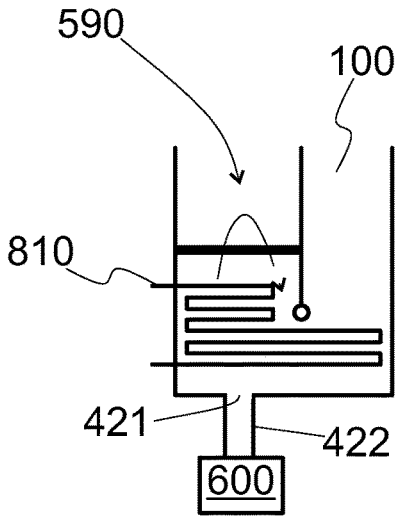

Referring to FIGS. 8*a* to 9*b*, in particular FIGS. 8*a* and 9*a*, the loopseal heat exchanger 10 comprises a fifth wall 550 limiting an inlet chamber 100 and a fifth channel 552. The loopseal heat exchanger 10 comprises an outlet wall 507 that limits the first particle outlet 590. In this way, the fifth wall 550 and the outlet wall 507 limit a heating path HP through which the bed material is configured to flow from the inlet 31 to the pipeline 15 via the first particle outlet 590. The outlet wall 507 is arranged downstream in the direction of bed material flow from the fifth wall 550. Moreover, to have a second gas lock formed by the heating path HP, the fifth channel 552 is arranged at a lower level than the first particle outlet 590. E.g. an upper edge of the fifth channel 552 may be arranged at a lower level than a lower edge of the first particle outlet 590. E.g. an upper edge of the fifth channel 552 may be arranged at least 500 mm, such as from 500 mm to 700 mm, lower than a lower edge of the first particle outlet 590. In this way, a second gas lock is arranged, in the direction of flow of the bed material, in between the fifth wall 550 and the outlet wall 507. This applies also for the embodiment of FIGS. 2*a* to 5, wherein the second gas lock is arranged in the feeding chamber 150.

Referring to FIG. 5, in an embodiment the loopseal heat exchanger 10 comprises a sixth wall 560 dividing the second compartment 22 to a heating chamber 320 and a discharge chamber 420. The sixth wall 560 may extend from the top of the second compartment 22 downwards. As indicated in FIG. 5, the flow of bed material in the heating chamber 320 may be substantially horizontal; however, the material may be fed to the heating chamber 320 from a channel located in an upper part of the chamber (in FIG. 5 upper right corner), and the material may be expelled from the heating chamber 320 through a channel located in lower part of the chamber (in FIG. 5 lower left corner).

The discharge chamber 420 may be referred to as a discharge upleg 420. In the discharge upleg 420, the flow of bed material may be substantially upwards, as indicated in FIG. 5. As indicated in FIGS. 6 to 9*b*, an embodiment does not comprise walls limiting a discharge upleg 420. In contrast, bed material may be discharged directly from the first 21 or the second compartment 22.

The fluidizing gas may be conveyed with the bed material to the furnace 50 via the pipeline 15. In the embodiment of FIGS. 2*a* to 5, the bed material is configured to flow substantially horizontally in the heating chambers 320, 330. However, if fluidizing gas would only flow with the bed material, also the fluidizing gas would be conveyed only below the wall 560 (see FIG. 5). Thus, the gas would not properly fluidize the bed material in e.g. the heating chamber 320 and near the heat exchanger tubes 820, at least some upper heat exchanger tubes 820. Therefore, preferably, the loopseal heat exchanger 10 comprises a gas outlet (423, 433, see FIGS. 2*a*, 2*b*, and 5) configured to, in use, let out fluidizing gas from an upper part of a heating chamber 320, 330 towards the pipeline 15. In this way, the wall 560, which divides the second compartment 22 to a heating chamber 320 and a discharge chamber 420 and limits in its lower part a flow path for bed material further limits in its upper part a gas outlet 423 for fluidizing gas. The size of the gas outlet(s) 423, 433 may be selected to be so small, that in use, the gas flow becomes directed towards the pipeline 15.

The temperature within a loopseal 5 is typically very high. It has been noticed that if regular heat exchanger tubes 810, 820 are used in the first 21 or second 22 compartment, two problems arise. First, since a regular heat exchanger tube conducts heat well, the temperature of the outer surface of the regular heat exchanger tubes will decrease because of the steam flowing inside the tube. As a result, the temperature of the outer surface of the regular heat exchanger tubes may decrease so much that corrosive compounds (e.g. alkali halides, such as alkali chlorides) may condense on the tubes. This poses corrosion problems. Second, the flow of bed material causes abrasion on the tubes. Moreover, the tubes need to withstand high pressures. Thus, durable heat exchanger tubes for the purpose are very expensive.

Figure 10:
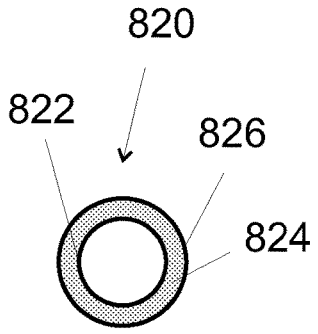
FIG. 10 shows a heat exchanger tube having an inner pipe and a radially surrounding outer pipe.

Referring to FIG. 10, it has been noticed, that when the heat exchanger tube 820 comprises an inner pipe 822 and a coaxial outer pipe 826, wherein some thermally insulating material 824 is arranged in between the inner pipe 822 and outer pipe 826, the corrosion and abrasion problems can be reduced. First, because of the thermally insulating material 824, the temperature of the outer surface of the heat exchanger tube remains high, thereby preventing alkali halides from condensing on the surfaces. Second, the outer pipe 826 takes in the abrasion resulting from bed material. And third, only the inner pipe 822 need to withstand a high pressure. In contrast, the pressure difference between an outer surface of the outer pipe 826 and an inner surface of the outer pipe 826 may be essentially zero. As for the thermally insulating material 824, at least one of air, bed material, sand, or mortar may be arranged in between the inner pipe and an outer pipe. The thermal conductivity of the thermally insulating material 824 may be e.g. at most 10 W/mK at 20° C.

In an embodiment, at least some of the heat exchanger tubes 820 of the first or second compartment comprise an inner pipe 822 configured to convey heat transfer medium such as water and/or steam, an outer pipe 826 configured to protect the inner heat exchanger tube 824, and some thermally insulating material in between the inner pipe and the outer pipe.

The heat exchanger tubes 820 may comprise at least a straight portion extending in a longitudinal direction of the tube. The inner pipe 822 may comprise at least a straight portion extending in the longitudinal direction of the tube 820. The outer pipe 826 may comprise at least a straight portion extending in the longitudinal direction of the tube 820 coaxially with the straight portion of the inner pipe 822. The inner diameter of the outer pipe 826 may be e.g. at least 1 mm more than the outer diameter of the inner pipe 822. The inner diameter of the outer pipe 826 may be e.g. from 1 mm 10 mm more than the outer diameter of the inner pipe 822. Thus, the thickness of the layer of the thermally insulating material 824 in between the inner pipe 822 and the outer pipe 826 may be e.g. from 0.5 mm to 5 mm, such as from 1 mm to 4 mm, such as from 1 mm to 2 mm.

The walls 500 of the loopseal heat exchanger may comprise heat transfer tubes. In an embodiment, a wall 500 of the walls 500 comprises heat transfer tubes. In an embodiment, also other walls (500, 505, 510, 520, 530, 540, 550, 560) of the loopseal heat exchanger 10 comprise heat transfer tubes. Also a heat transfer tube of a wall 500 may comprise an inner pipe and a coaxial outer pipe, wherein some thermally insulating material is arranged in between the inner and outer pipe. In addition, the heat transfer tubes of the walls wall may be formed of inner pipes and a coaxial outer pipes, wherein some thermally insulating material is arranged in between the inner and outer pipes. What has been said about the structure of heat exchanger tubes (within the second compartment) applies to heat transfer tubes (or the walls).

Referring to FIGS. 6 to 9*b*, a loopseal heat exchanger 10 may function also without a feeding chamber 150. In a corresponding embodiment, the bed material is configured to flow directly from the inlet chamber 100 to the heat exchanger tubes 810, such as heat exchanger tubes of the first or second compartment 21, 22. When the loopseal heat exchanger 10 is free from a feeding chamber 150, at least some of the walls 500 of the loopseal heat exchanger are vertical walls 505 and the walls 500 of the loopseal exchanger limit a first flow path P1 along which bed material is configured to flow, in use, from the inlet 31 for receiving bed material to the heat exchanger tubes 810, 820, 830. Moreover, only at most one such vertical wall 505 of the walls of the loopseal heat exchanger 10 that protrudes to the interior 11 of the loopseal heat exchanger is arranged on top of the first flow path P1 or below the first flow path P1. In the embodiments of FIGS. 8*a* and 8*b*, one such vertical wall is arranged above the first flow path P1. However, as indicated in FIG. 8*c*, when the inlet chamber 100 comprises heat exchanger tubes, no vertical wall needs to be arranged on the flow path P1. In FIG. 8*c*, the first flow path P1 may be considered to be substantially downwards (see FIG. 1). In the embodiments of FIGS. 8*a* and 8*b* the wall 506 extends in the vertical direction from the bottom of the loopseal heat exchanger to the top of the loopseal heat exchanger in order to guide the bed material to the first flow path P1. Correspondingly, the wall 550 does not extend to the bottom in order to form the first flow path P1.

Referring to FIGS. 6 to 8*c*, a loopseal heat exchanger 10 may function also without a discharge chamber 420. When the loopseal heat exchanger 10 is free from a discharge chamber 420, the walls of the loopseal exchanger limit a second flow path P2 along which bed material is configured to flow, in use, from the heating chamber 320 to the first particle outlet 590. Moreover, no such vertical wall 505 of the walls 500 of the loopseal heat exchanger 10 that that protrudes to the interior 11 of the loopseal heat exchanger is arranged on top of the second flow path P2 or below the second flow path P2. The heating chamber 320 refers to a chamber comprising heat exchanger tubes 810, 820 arranged in the interior of the heating chamber. The interior is, on the other hand, limited by the walls, which may comprise further heat transfer tubes.

As indicated in FIGS. 8*a* to 8*c*, the heat exchanger tubes 810 typically comprise straight portions, which are parallel. As indicated in FIGS. 8*a* and 8*b*, the direction dt of the heat exchanger tubes may be e.g. parallel (as in FIG. 8*a*) or perpendicular (as in FIG. 8*b*) to the direction db of flow of bed material. In principle also any other orientation is possible, however that may be technically hard to manufacture. In an embodiment, at least one of the heat exchanger tubes 810 is arranged in one of the chambers of the loopseal heat exchanger. The heat exchanger tubes 810 comprises a straight portion extending in a longitudinal direction dt of the heat exchanger tube. Moreover, in that chamber, bed material is configured to flow in a direction db of bed material flow such that the direction of bed material flow [i] is parallel with the longitudinal direction of the tube or [ii] forms and angle α with the longitudinal direction of the tube. The angle α refers to the smaller of the two angle defined by two lines. Furthermore, the heat exchanger tube and the material flow may be configured such that the angle α is from 0 to 45 degrees or from 45 to 90 degrees. Preferably the angle α is from 0 to 30 degrees or from 60 to 90 degrees, such as from 0 to 15 degrees or from 75 to 90 degrees. As indicated in FIGS. 8*a* and 8*b*, when such configured, the inlet 800 for the heat exchanger tubes 810 can be easily arranged relative to the chambers of the loopseal heat exchanger 10.

Referring to FIG. 1, in an embodiment, the circulating fluidized bed boiler 1 comprises also another heat exchanger (26, 28) or multiple other heat exchangers, such as economizes 26 and superheaters 28 arranged within a flue gas channel 20 downstream from the cyclone 40 (see FIG. 1) in the direction of flue gas flow. The loopseal heat exchanger and the other heat exchangers (or the other heat exchangers) are arranged as part of a same circulation of heat transfer medium. Moreover, preferably, the loopseal heat exchanger 10 is arranged, in the direction of flow of the heat transfer medium within the circulation of heat transfer medium as the last heat exchanger to recover heat to the heat transfer medium. Thus, preferably, no such heat exchanger that would be configured to recover heat to the heat transfer medium is arranged in between the loopseal heat exchanger and the point of use of the heat transfer medium. The point of use is typically a steam turbine configured to produce electricity using the heat transfer medium. The heat transfer medium is typically steam and/or water. Correspondingly, the loopseal heat exchanger 10 is arranged, in the direction of flow of the heat transfer medium, downstream from all other heat exchangers 26, 28 configured to heat the heat transfer medium. Within the loopseal heat exchanger 10, the heat transfer medium is typically in the form of steam, but earlier in the circulation, e.g. in the economizers 28, the heat transfer medium is typically in the form of water.

The invention claimed is:

1. A circulating fluidized bed boiler, comprising
a furnace,
a cyclone for separating bed material from gases,
a loopseal, and
a loopseal heat exchanger arranged in the loopseal,
the loopseal heat exchanger comprising:
walls limiting an interior of the loopseal heat exchanger,
a first particle outlet for letting out particulate material from the loopseal heat exchanger,
an inlet for receiving bed material from the furnace via the cyclone,
heat exchanger tubes arranged in the interior of the loopseal heat exchanger,
a first ash removal channel configured to let out ash from the loopseal heat exchanger, and
an ash cooler configured to receive ash from the first ash removal channel such that the ash is not conveyed via the furnace from the loopseal heat exchanger to the ash cooler,
wherein:
the first ash removal channel is arranged at a lower level than the first particle outlet,
the walls limit a first compartment comprising the inlet for receiving bed material and a second compartment comprising the heat exchanger tubes,
a first wall of the walls separates the first compartment from the second compartment and limits a first channel for conveying bed material from the first compartment to the second compartment, and
the first ash removal channel is configured to let out ash from either the first compartment or the second compartment.

2. The circulating fluidized bed boiler of claim 1, wherein:
the first ash removal channel is configured to let out ash from the first compartment, and
the loopseal heat exchanger comprises a second ash removal channel configured to let out ash from the second compartment.

3. The circulating fluidized bed boiler of claim 2, wherein the second ash removal channel is arranged at a lower level than the first particle outlet.

4. The circulating fluidized bed boiler of claim 2 wherein a part of the first wall limits both the first compartment and the second compartment.

5. The circulating fluidized bed boiler of claim 2, wherein:
the walls of the loopseal heat exchanger limit a third compartment comprising heat exchanger tubes configured to recover heat from bed material within the loopseal heat exchanger, and
a second wall of the walls separates the third compartment from the first compartment and limits a second channel for conveying bed material from the first compartment to the third compartment.

6. The circulating fluidized bed boiler of claim 5, further comprising a third ash removal channel configured to let out ash from the third compartment.

7. The circulating fluidized bed boiler of claim 6, wherein the third ash removal channel is arranged at a lower level than the first particle outlet.

8. The circulating fluidized bed boiler of claim 2, wherein the first compartment comprises heat exchanger tubes.

9. The circulating fluidized bed boiler of claim 1, wherein:
a third wall of the walls separates a bypass chamber from an inlet chamber, the inlet chamber comprising the inlet, the first ash removal channel is configured to let out ash from the bypass chamber, and
the loopseal heat exchanger comprises a second ash removal channel configured to let out ash from another chamber of the loopseal heat exchanger.

10. The circulating fluidized bed boiler of claim 1, wherein:
a third wall of the walls limits an inlet chamber and a bypass chamber, the inlet chamber comprising the inlet for receiving bed material,
the third wall limits a third channel for conveying bed material from the inlet chamber to the bypass chamber, and
a fourth wall of the walls limits the bypass chamber and a second particle outlet for letting out particulate material from the loopseal heat exchanger.

11. The circulating fluidized bed boiler of claim 1, further comprising nozzles configured to fluidize bed material within the loopseal heat exchanger by fluidizing gas.

12. The circulating fluidized bed boiler of claim 11, wherein at least a first nozzle of the nozzles is configured to drive ash mainly towards the first ash removal channel by a flow of the fluidizing gas.

13. The circulating fluidized bed boiler of claim 11, wherein:

a first set of the nozzles are configured to fluidize bed material within a first compartment, a second set of the nozzles are configured to fluidize bed material within a second compartment, and the circulating fluidized bed boiler further comprises a control unit configured to control the flow of air through the first set of nozzles and to control the flow of air through the second set of nozzles independently of the flow of air through the first set of nozzles.

14. The circulating fluidized bed boiler of claim 11, wherein:

a primary set of the nozzles are configured to fluidize bed material within a bypass chamber, a secondary set of the nozzles are configured to fluidize bed material outside of the bypass chamber, and the circulating fluidized bed boiler further comprises a control unit configured to control the flow of air through the primary set of nozzles and to control the flow of air through the secondary set of nozzles independently of the flow of air through the primary set of nozzles.

15. The circulating fluidized bed boiler of the claim 1, wherein an upper edge of the first ash removal channel is arranged at least one meter lower than a lower edge of the first particle outlet.

16. The circulating fluidized bed boiler of claim 1, wherein:

at least some of the walls of the loopseal heat exchanger are vertical walls.

the walls of the loopseal exchanger limit a first flow path along which bed material is configured to flow, in use, from the inlet to heat exchanger tubes arranged in the interior of the loopseal heat exchanger, and only at most one such a vertical wall that protrudes to the interior of the loopseal heat exchanger is arranged on top of the first flow path or below the first flow path.

17. The circulating fluidized bed boiler of claim 1, wherein:

at least some of the walls of the loopseal heat exchanger are vertical walls, the walls of the loopseal exchanger limit a second flow path along which bed material is configured to flow, in use, from the heat exchanger tubes arranged in the interior of the loopseal heat exchanger to the first particle outlet, and no such a vertical wall that protrudes to the interior of the loopseal heat exchanger is arranged on top of the second flow path or below the second flow path.

* * * * *